US011107338B2

(12) United States Patent
Badri et al.

(10) Patent No.: US 11,107,338 B2
(45) Date of Patent: Aug. 31, 2021

(54) SYSTEMS AND METHODS FOR FIRE DETECTION

(71) Applicant: CoreKinect LLC, Tempe, AZ (US)

(72) Inventors: Assar Badri, Scottsdale, AZ (US); Mitchel Kelley, Gilbert, AZ (US); Almedin Kozlica, Phoenix, AZ (US)

(73) Assignee: COREKINECT LLC, Tempe, AZ (US)

( * ) Notice: Subject to any disclaimer, the term of this patent is extended or adjusted under 35 U.S.C. 154(b) by 0 days.

(21) Appl. No.: 17/152,391

(22) Filed: Jan. 19, 2021

(65) Prior Publication Data

US 2021/0225145 A1 Jul. 22, 2021

Related U.S. Application Data

(60) Provisional application No. 62/964,217, filed on Jan. 22, 2020.

(51) Int. Cl.

| | |
|---|---|
| ***G08B 17/00*** | (2006.01) |
| ***G08B 27/00*** | (2006.01) |
| ***G08B 21/02*** | (2006.01) |
| ***G08B 21/14*** | (2006.01) |
| ***G08B 17/06*** | (2006.01) |

(52) U.S. Cl.

CPC ..... *G08B 17/005* (2013.01); *G08B 17/06* (2013.01); *G08B 21/023* (2013.01); *G08B 21/14* (2013.01); *G08B 27/006* (2013.01)

(58) Field of Classification Search

CPC ..... G08B 17/005

See application file for complete search history.

(56) References Cited

U.S. PATENT DOCUMENTS

| | | | | |
|---|---|---|---|---|
| 6,624,750 | B1 * | 9/2003 | Marman | G08B 25/003 340/4.3 |
| 2004/0183021 | A1 * | 9/2004 | Luck | G08B 25/10 250/347 |
| 2005/0200492 | A1 * | 9/2005 | Woodard | G08B 21/14 340/632 |
| 2018/0062870 | A1 * | 3/2018 | Rovito | H04L 41/0816 |
| 2018/0374330 | A1 * | 12/2018 | Balaji | G08B 25/14 |
| 2019/0287363 | A1 * | 9/2019 | Balaji | G08B 25/14 |

* cited by examiner

*Primary Examiner* — Travis R Hunnings

(74) *Attorney, Agent, or Firm* — Noblitt & Newson, PLLC

(57) ABSTRACT

A system for remote detection of a fire condition includes a plurality of remote sensors and a central hub connected to each sensor to create a localized network capable of detecting changes in environmental conditioned within a geographic area defined by the locations of the sensors. The sensors may be configured to detect conditions such as changes in temperature, levels of carbon dioxide, smoke or other fire related particulates and report sensor readings back to the connected hub. The hub processes received sensor data from each sensor and generates an alert if the processed data meets any predetermined condition such as one associated with a fire. The alert may be transmitted to a tracking station with a geographic indication of where the alert was generated and a drone may be sent to the location of the geographic indication to acquire additional data to help determine if further action is required.

16 Claims, 3 Drawing Sheets

SYSTEMS AND METHODS FOR FIRE DETECTION

CROSS-REFERENCES TO RELATED APPLICATIONS

This application claims the benefit of U.S. Provisional Patent Application No. 62/964,217, filed Jan. 22, 2020, and incorporates the disclosure of the application by reference.

BACKGROUND OF THE TECHNOLOGY

Wildfires that occur in remote locations such as national forests and other public lands are often hard to detect until they have grown quite large. For example, unless a watch station is able to detect the early signs of a fire, the fire may grow undetected until the smoke is detected by an aircraft or satellite. This may lead to a fire becoming quite large before it is detected. In particularly dry conditions, a fire may expand exponentially and rapidly progress towards inhabited areas. As drought conditions extend for consecutive years, the possibility for rapidly growing fires increasingly necessitates a way to more quickly detect fires. Early detection may help fire suppression efforts by provided additional hours or days to monitor a fire and plan for how best to address it.

SUMMARY OF THE TECHNOLOGY

A system for remote detection of a fire condition includes a plurality of remote sensors and a central hub connected to each sensor to create a localized network capable of detecting changes in environmental conditions within a geographic area defined by the locations of the sensors. The sensors may be configured to detected conditions such as changes in temperature, levels of carbon dioxide, smoke or other fire related particulates and report sensor readings back to the connected hub. The hub processes received sensor data from each sensor and generates an alert if the processed data meets any predetermined condition such as one associated with a fire. The alert may be transmitted to a tracking station with a geographic indication of where the alert was generated and a drone may be sent to the location of the geographic indication to acquire additional data to help determine if further action is required.

BRIEF DESCRIPTION OF THE DRAWINGS

A more complete understanding of the present technology may be derived by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in a different order are illustrated in the figures to help to improve understanding of embodiments of the present technology.

DETAILED DESCRIPTION OF EXEMPLARY EMBODIMENTS

The present technology may be described in terms of functional block components and various processing steps. Such functional blocks may be realized by any number of components configured to perform the specified functions and achieve the various results. For example, the present technology may employ various materials, dimensions, and geometries, which may carry out a variety of operations suited to a specified application or environment. In addition, the present technology may be practiced in conjunction with any number of devices for conducting electrical signals, monitoring one or more conditions, and transmitting and/or receiving data, and the system described is merely one exemplary application for the technology.

A system for remote detection of a fire condition according to various aspects of the present technology may operate in conjunction with any type of security tape or conductive material. Various representative implementations of the present technology may be applied to systems for sensing or detecting specified environmental conditions in remote locations. For example, the described technology may be used to create a sensing system for remote locations such as a national forest that are able to detect early signs of a forest or wildfire and report that detection to a monitoring station or data center.

Figure 1:
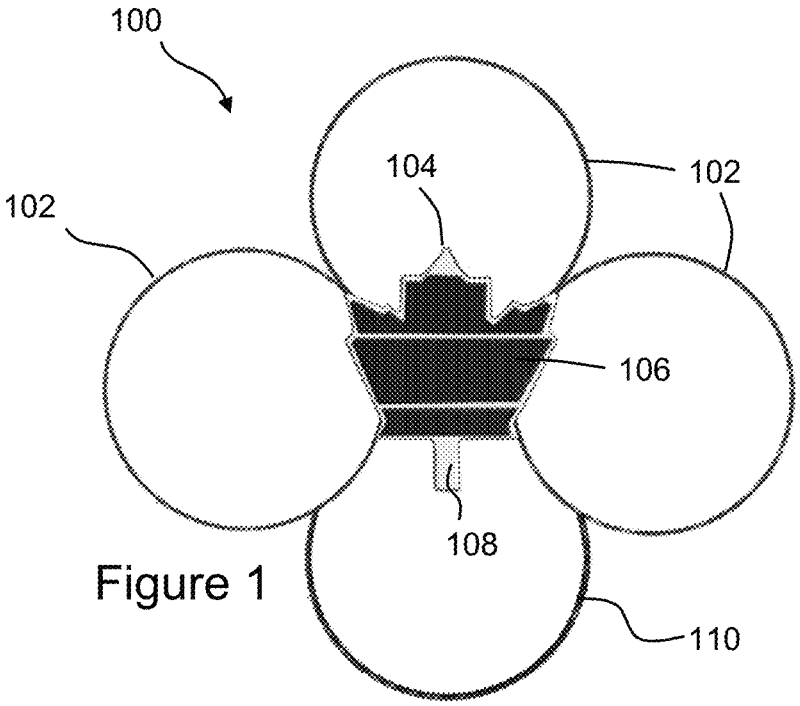
FIG. 1 representatively illustrates a top view of a deployable sensor in accordance with an exemplary embodiment of the present technology.
Figure 2:
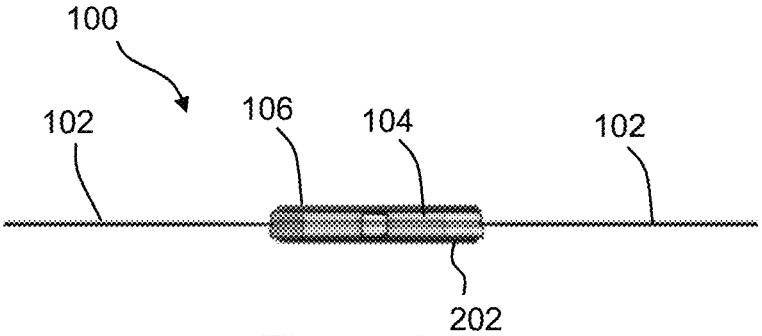
FIG. 2 representatively illustrates a side view of the deployable sensor in accordance with an exemplary embodiment of the present technology.
Figure 3:
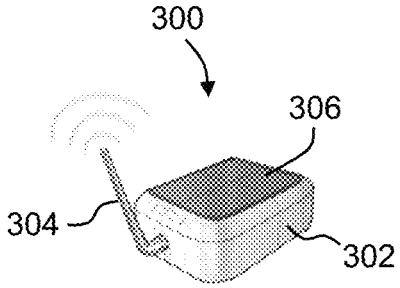
FIG. 3 representatively illustrates a deployable hub in accordance with an exemplary embodiment of the present technology.

Referring to FIGS. 1 and 2, in one representative embodiment, the system for remote detection of a fire condition may comprise a deployable sensor 100 having a sensor body 104 and at least one antenna extending outwardly from the sensor body 104.

The sensor body 104 is configured to detect one or more predetermined conditions and may comprise any suitable system or sensor for detecting the predetermined conditions. For example, the sensor body 104 may be configured to detect one or more conditions associated with a fire condition such as a specified temperature or change in rate of temperature; a specified level of a gas such as: carbon monoxide; carbon dioxide; or nitrogen dioxide; or a change in rate of a detected gas level in parts per million. The sensor body may be further configured to transmit detected conditions over a wireless communication network.

The sensor body 104 may comprise any suitable size or shape. For example, in one embodiment, the sensor body 104 may be configured to be deployed into the upper branches of a tree and be generally leaf shaped to blend in with the actual leaves on a given type of tree. The sensor body 104 may also be configured to be lightweight to better resist falling out of the tree.

The sensor body 104 may comprise a circuit card positioned within the sensor body 104 and a set of solar cells 106 disposed along an exterior facing surface of the sensor body 104. A second set of solar cells 202 may also be positioned along a second exterior facing surface of the sensor 104 opposite that of the first set of solar cells 106. The sensor body 104 may further comprise a rechargeable power supply electrically coupled to the first and second sets of solar cells 106, 202 and be configured to power the circuit card.

The rechargeable power supply may provide power to each of the electronic components on the circuit card. In some embodiments, the battery may be any thin film, flexible, or printed battery cell that may allow for safe transmission of power to the electronic components without risk of fire. For example, the battery may comprise a device such as: advanced lithium-ion batteries; solid-state batteries; micro-batteries; stretchable batteries; thin flexible supercapacitors; thin film battery; zinc ink printed polymer battery; or a manganese dioxide-based battery.

The circuit card may comprise a circuit board having a microcircuit, a pair of battery terminals, and one or more sensor devices positioned on an exposed section 108 of the sensor body 104. The circuit board may be positioned on a flexible PCB substrate. The flexible PCB substrate may comprise any nonconductive material such as a nonconductive plastic. For example, the flexible substrate may comprise polyamide, polyethylene terephthalate (PET), and/or polybutylene terephthalate (PBT).

The microcircuit may comprise a main microcontroller, input output ports (I/O ports), a memory device and any other suitable components. For example, in one embodiment, the microcircuit may comprise a wireless communication device such as a Bluetooth or other wireless transmitter or a micro Global Positioning System (GPS) chip that is configured to generate a signal for transmission by the communication device in response to the detection of a specified condition. The microcircuit may also be programmed to conserve the life of the battery. For example, the microcircuit may transmit packets of sensor data at preselected intervals, in response to a signal from an onboard sensor, or in response to a wireless signal from another device.

The sensor devices may be integrated into the circuit card and are configured to collect sensor data relating to one or more specified environmental conditions such as temperature, air particulates, movement, and concentration levels of one or more gases present in the ambient air. The sensor devices may comprise any suitable system or device for detecting, sensing, or otherwise recording a specified environmental condition. For example, in one embodiment, a sensor device may comprise a temperature compensated printed electrochemical carbon monoxide sensor positioned on the exposed section 108 of the sensor body 104. Similarly, a temperature sensor may also be located on the exposed section 108 of the sensor body 104. The sensor devices may be configured to measure a current value based on the sensed condition or the sensor devices may be configured to measure a rate in change of the sensed condition over a given period of time. The circuit card may include any additional types of sensors such as: an accelerometer, gyro, magnetometer, pressure sensor, temperature sensor, haptic driver, memory device, transmitter/receiver, a micro Global Positioning System (GPS) chip, display device, control buttons, or any other suitable like sensors and components.

Figure 6:
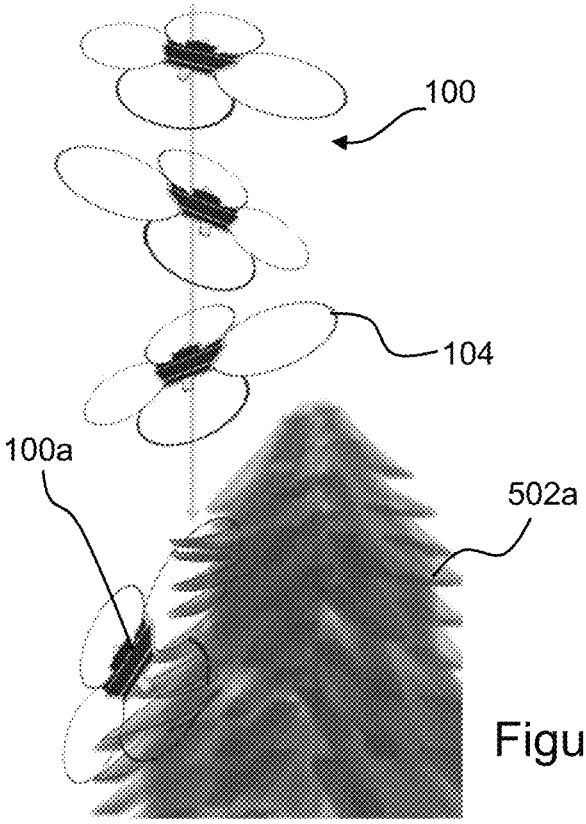
FIG. 6 representatively illustrates a detailed view of a deployed sensor positioned on a tree in accordance with an exemplary embodiment of the present technology.
Figure 7:
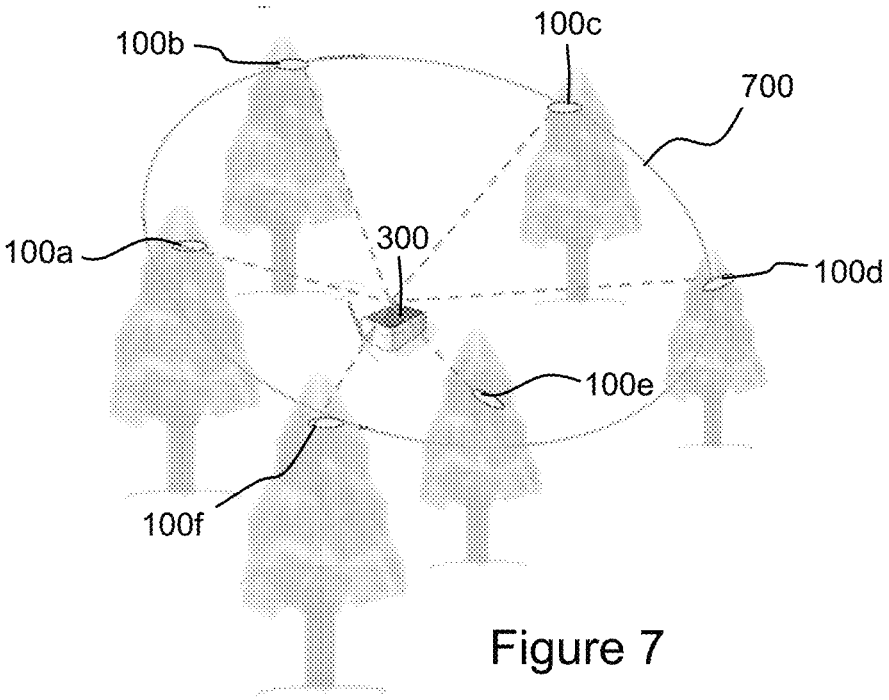
FIG. 7 representatively illustrates a deployed sensing network in accordance with an exemplary embodiment of the present technology.

The antenna allows the sensor body 104 to communication with one or more remote devices. For example, the antenna of the sensor device may be configured as a transceiver for both receiving and transmitting sensor data. The antenna may also be configured to assist with the deployment of the deployable sensor 100. Referring now to FIGS. 1 and 6, in one embodiment the antenna may comprise a loop antenna configured to go around and extend outwardly from the sensor body 104. For example, the loop antenna may be formed with a plurality of loops 102 that are configured to snag or hook onto a branch of a tree 502*a* so that the deployable sensor 100 is positioned above ground level to obtain better access to prevailing winds and environmental conditions. In one embodiment, a first loop 102 may be connected at a first end to the sensor body 104 at a first location and a second end of the loop may be connected to a second location of the sensor body 104 to form a loop that extends outwardly away from the sensor body 104. A second loop 102 may then be connected at a first end proximate the second location of the sensor body 104 and connect on a second end to a third location of the sensor body 104 to form a second loop 102 that extends outwardly away from the sensor body 104. Additional loops 102 may be similarly formed to increase the chances that the deployable sensor 100 will get attached to the tree 502*a* on deployment. Alternatively, a loop 110 may be formed by being connected on each end to an adjacent loop 102.

The loops 102, 110 may comprise any suitable size or shape to facilitate connection to the tree 502*a* or other object. In one embodiment, the loops 102, 110 may be substantially round while in a second embodiment the loops 102, 110 may comprise one or more corners designed to provide a wedged grip to a branch or tree canopy. The loops 102, 110 may also be configured to adjust their size after looping around a branch. For example, each loop 102, 110 may comprise snare-like configuration such that after a loop 102, 110 has gripped onto a branch, the weight of the sensor body 104 may cause the diameter of the loop 102, 110 that hooked onto the branch to get smaller thereby decreasing a likelihood that the deployable sensor 100 will become disconnected from the branch due to winds or other factors over time.

Referring now to FIGS. 3-5, and 7, a sensor hub 300 may be positioned proximate a plurality of deployable sensors 100 to create a localized sensing network. For example, the deployable sensors 100 may be arranged around the sensor hub 300 to form a network based on star topology. Other examples of possible network configurations may include mesh networks, repeaters, and daisy chains. The sensor hub 300 may be configured to operate from a ground location or suspended above ground similar to that described for the deployable sensors 100.

The sensor hub 300 may collect sensor data from each deployable sensor 100 within a predetermined geographic distance or that is able to establish a communication channel. The sensor hub 300 may comprise a transceiver 304 for communication with the plurality of deployable sensors 100 and for transmitted sensor data to a remote monitoring station or data center. The sensor hub 300 may also comprise a solar cell 306 configured to recharge an onboard power source similar to that used in the deployable sensors 100.

The sensor hub 300 may comprise any suitable system or device for receiving sensor data from each connected deployable sensor 100. The sensor hub 300 may be GPS enabled and be configured to communication with the remote monitoring station or data center through any suitable method such as: Cellular; wireless area networks (e.g. LPWAN, LoRa, RPMA, Zigbee, and BLE); and satellite networks.

The sensor hub 300 may also be configured to perform at least some analysis of the received sensor data to determine if a fire condition has been detected. In the event of a detected fire condition, the sensor hub 300 may transmit a signal to the remote monitoring station or data center for review or action. The transmitted signal may comprise any suitable data such as the GPS coordinates of the sensor hub 300 or the deployable sensor 100 primarily responsible for the detected fire condition.

Figure 4:
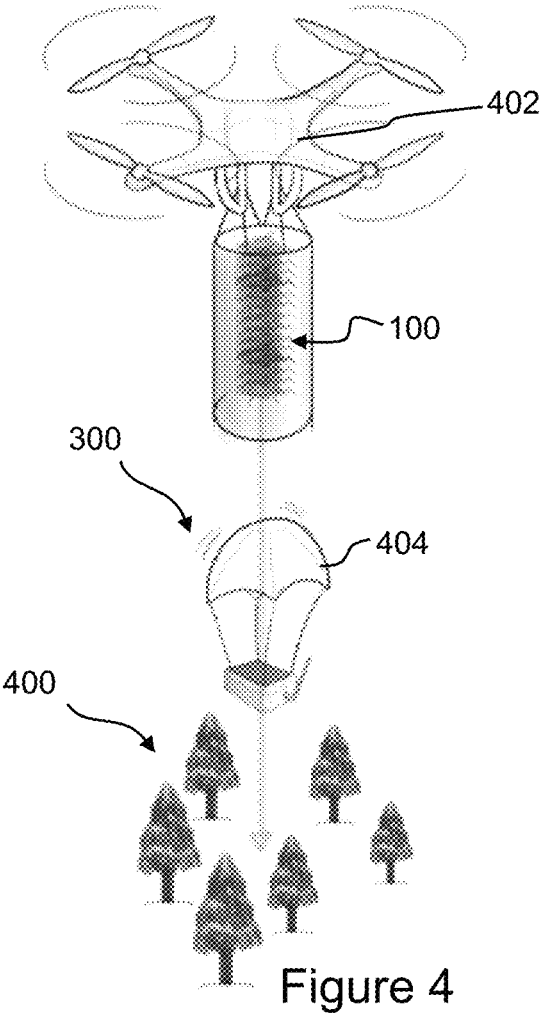
FIG. 4 representatively illustrates a deployment of the hub into a remote location in accordance with an exemplary embodiment of the present technology.
Figure 5:
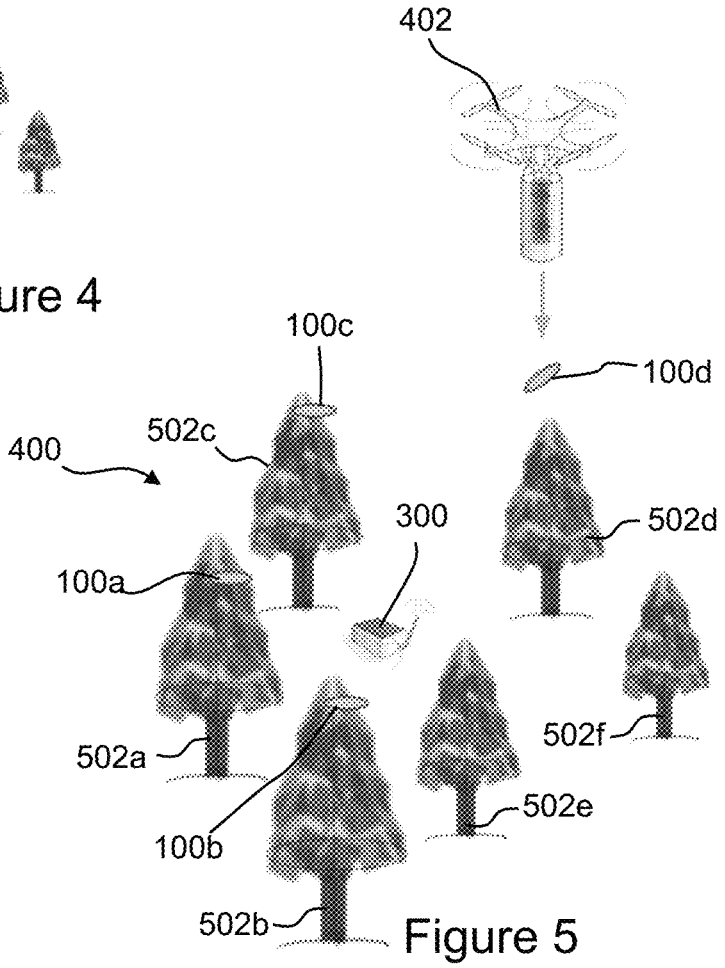
FIG. 5 representatively illustrates a deployment of a plurality of deployable sensors into the remote location in accordance with an exemplary embodiment of the present technology.

Referring now to FIGS. 4-6, in operation, one or more drones may be used to deliver the sensor hub 300 and a plurality of deployable sensors 100 to a remote area. To create a sensing network, a drone may first deploy the sensor hub 300 into a location 400. The location 400 may comprise an open area allowing for the sensor hub 300 to be delivered in a manner to allow for proper operation. For example, the sensor hub 300 may comprise a deployable parachute configured to deliver the sensor hub 300 to the ground such that the solar cell 306 is facing upwards and is generally free of overhead obstacles.

Once the sensor hub 300 has been delivered to the location 400, the drone may begin deploying individual deployable sensors 100*a*-100*f* by dropping them individually from various locations generally surrounding the location 400 where the sensor hub 300 was delivered. For example, a first deployable sensor 100*a* may be dropped from the drone above a first tree 502*a* such that one of the antenna loops 102 of the deployable sensor 100*a* engage or otherwise hook onto a brand of the first tree 502*a*. After the first deployable sensor 100*a* has been delivered, it may begin a process of establishing a communication link with the sensor hub 300. The drone may then continue dropping additional deployable sensors 100*b*-100*f* over other trees 502*b*-502*f* to complete the sensor network 700. Alternatively, the individual deployable sensors 100*a*-100*f* may be deployed into a region and then the sensor hub 300 may be deployed into a location having a higher probably of establishing a communication link with the greatest number of deployable sensors 100.

After the sensor network 700 is in place, the sensor hub 300 may establish a communication link with the remote monitoring station or data center. The sensor hub 300 may then send periodic updates of sensor information, operating status, or any other suitable information. In the event that a fire condition is detected, the sensor hub 300 may send an immediate signal to the remote monitoring station or data center where the sensor data may be further analyzed or acted upon. For example, the remote monitoring station or data center may send a second signal to a government agency or fire department. Alternatively, the remote monitoring station or data center may be configured to launch a drone with instructions to travel to the GPS location of the sensor network 700 to perform a visual inspection of the area. If a fire condition is confirmed, the remote monitoring station or data center may then transmit a fire notice to the appropriate entity.

These and other embodiments for remote detection of a fire condition may incorporate concepts, embodiments, and configurations as described above. The particular implementations shown and described are illustrative of the technology and its best mode and are not intended to otherwise limit the scope of the present technology in any way. Indeed, for the sake of brevity, conventional manufacturing, connection, preparation, and other functional aspects of the system may not be described in detail. Furthermore, the connecting lines shown in the various figures are intended to represent exemplary functional relationships and/or physical couplings between the various elements. Many alternative or additional functional relationships or physical connections may be present in a practical system.

The description and figures are to be regarded in an illustrative manner, rather than a restrictive one and all such modifications are intended to be included within the scope of the present technology. Accordingly, the scope of the technology should be determined by the generic embodiments described and their legal equivalents rather than by merely the specific examples described above. For example, the components and/or elements recited in any apparatus embodiment may be assembled or otherwise operationally configured in a variety of permutations to produce substantially the same result as the present technology and are accordingly not limited to the specific configuration recited in the specific examples.

As used herein, the terms "comprises," "comprising," or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present technology, in addition to those not specifically recited, may be varied or otherwise particularly adapted to specific environments, manufacturing specifications, design parameters or other operating requirements without departing from the general principles of the same.

The present technology has been described above with reference to exemplary embodiments. However, changes and modifications may be made to the exemplary embodiments without departing from the scope of the present technology. These and other changes or modifications are intended to be included within the scope of the present technology, as expressed in the following claims.

The invention claimed is:

1. A monitoring network for detecting remote fire conditions, comprising:

a plurality of sensors, wherein each sensor comprises:

a set of solar cells disposed along a first surface of a body;

a second set of solar cells disposed along a second surface of the body and facing opposite that of the first surface;

a circuit card disposed along a portion of the body comprising:

at least one sensor device; and a transmitter configured to transmit collected sensor data;

a rechargeable power supply electrically coupled to the first and second sets of solar cells and configured to power the circuit card;

an antenna, comprising:

a first end connected to a first body segment; and a second end connected to a second body segment to form an open loop between the first and second body segments that extends outwardly from the body;

a sensor hub configured to:

communicate with each sensor over a local network having an area defined by a geographic location of the plurality of sensors capable of transmitting sensor data to the sensor hub;

receive sensor data from each sensor;

process received sensor data from each sensor; and communicate processed sensor data to a data center.

2. A monitoring network for detecting remote fire conditions according to claim 1, wherein the circuit card is formed on a flexible substrate.

3. A monitoring network for detecting remote fire conditions according to claim 1, wherein the at least one sensor device comprises at least one of a carbon monoxide sensor and a temperature sensor.

4. A monitoring network for detecting remote fire conditions according to claim 1, wherein the battery comprises at least one of a printed polymer battery, a thin film battery, and a supercapacitor.

5. A monitoring network for detecting remote fire conditions according to claim 1, wherein the circuit card further comprises a GPS tracking chip.

6. A monitoring network for detecting remote fire conditions according to claim 1, wherein the sensor hub comprises a deployable parachute.

7. A monitoring network for detecting remote fire conditions according to claim 1, further comprising at least one additional antenna, having:

a first end connected to a third body segment; and a second end connected to a fourth body segment to form a second open loop between the third and fourth body segments that extends outwardly from the body.

8. A method of deploying a monitoring network for detecting remote fire conditions, comprising:

deploying a sensor hub into a remote location by flying the sensor hub to the remote location and dropping the sensor hub from a height above the remote location;

deploying a plurality of sensors into a geographic area surrounding the deployed sensor hub to form a local network having an area defined by a geographic location of the plurality of sensors by flying the plurality of sensors to the remote location and dropping each sensor from a height some horizontal distance away from the remote location where the sensor hub was deployed, wherein each sensor comprises:

a set of solar cells disposed along a first surface of a body;

a circuit card disposed along a portion of the body comprising:

at least one sensor device; and a transmitter configured to transmit collected sensor data;

a rechargeable power supply electrically coupled to the first set of solar cells and configured to power the circuit card;

an antenna, comprising:

a first end connected to a first body segment; and a second end connected to a second body segment to form an open loop between the first and second body segments that extends outwardly from the body;

collecting a continuous set of sensor data with the deployed plurality of sensors and transmitting the collected sensor data to the sensor hub;

processing received sensor data from each sensor; and communicating processed sensor data to a data center.

9. A method of deploying a monitoring network for detecting remote fire conditions according to claim 8, wherein each deployed sensor is released above a tree.

10. A method of deploying a monitoring network for detecting remote fire conditions according to claim 8, wherein each sensor further comprises a second set of solar cells disposed a second surface of the body and facing opposite that of the first surface.

11. A method of deploying a monitoring network for detecting remote fire conditions according to claim 8, wherein the circuit card is formed on a flexible substrate.

12. A method of deploying a monitoring network for detecting remote fire conditions according to claim 8, wherein the at least one sensor device comprises at least one of a carbon monoxide sensor and a temperature sensor.

13. A method of deploying a monitoring network for detecting remote fire conditions according to claim 8, wherein the battery comprises at least one of a printed polymer battery, a thin film battery, and a supercapacitor.

14. A method of deploying a monitoring network for detecting remote fire conditions according to claim 8, wherein the circuit card further comprises a GPS tracking chip.

15. A method of deploying a monitoring network for detecting remote fire conditions according to claim 8, wherein the sensor hub comprises a deployable parachute.

16. A method of deploying a monitoring network for detecting remote fire conditions according to claim 8, further comprising at least one additional antenna, having:

a first end connected to a third body segment; and a second end connected to a fourth body segment to form a second open loop between the third and fourth body segments that extends outwardly from the body.

* * * * *